United States Patent [19]

Jwuc

[11] 4,119,209

[45] Oct. 10, 1978

[54] LOCKING MECHANISM OF A RAILROAD CAR COUPLER

[75] Inventor: Karl J. Jwuc, Tallmadge, Ohio

[73] Assignee: Midland-Ross Corporation, Cleveland, Ohio

[21] Appl. No.: 809,181

[22] Filed: Jun. 23, 1977

[51] Int. Cl.[2] ..... B61G 3/06

[52] U.S. Cl. ..... 213/121; 213/129

[58] Field of Search ..... 213/121, 125, 129, 162

[56] References Cited

U.S. PATENT DOCUMENTS

| | | | |
|---|---|---|---|
| 445,248 | 1/1891 | Flohr | 213/125 |
| 2,646,896 | 7/1953 | Metzger | 213/121 |
| 3,845,867 | 11/1974 | Jwuc | 213/121 |

*Primary Examiner*—Trygve M. Blix

*Assistant Examiner*—Charles E. Frankfort

*Attorney, Agent, or Firm*—Harlan E. Hummer

[57] ABSTRACT

A railroad car coupler having a chambered head on which is mounted a knuckle that is rotatable between a closed position and an open position. A lock is provided within a chamber of the head to maintain the knuckle in a closed position. The lock is movable to a lockset position where the knuckle is free to rotate to an open position. A lever having projecting trunion for engaging the lock and around which the lock rotates, is also movable within the chamber for rotating the lock to the lockset position. The lever is provided with a projecting lug adjacent the trunion. The lug is designed to cooperate with a ledge, formed within the head, to limit axial movement of the trunion to prevent the trunion from becoming disengaged from the lock.

10 Claims, 11 Drawing Figures

(PRIOR ART)

LOCKING MECHANISM OF A RAILROAD CAR COUPLER

BACKGROUND OF THE INVENTION

The invention is an improvement in the locking mechanism disclosed in the Karl Jwuc U.S. Pat. No. 3,845,867. The locking mechanism of this patent employs a lock lifting lever having a specially configured free distal end which carries a trunion around which the U-shaped lock tiltably rotates. Occasionally this end of the lever becomes hung up on a rib that is formed in the chamber of the head of the car coupler adjacent the lever. Further, the locking mechanism of this patent is such that, when the lock is lifted from a normal rest position in interlocked relation with a closed knuckle, the unbalanced weighting of the lock about the trunion created by the eccentric mounting of the lock on the trunion of the lever, causes the lock to tilt and rotate freely to a lockset position, where the knuckle is free to rotate from a closed to an open position. There is no positive engagement of the lock with any other component of the coupler to cause initial movement of the lock to the lockset position. The present invention is directed to the solution of these two problems.

Briefly stated, the invention is in a car coupler comprising a chambered head having a front face, and a knuckle which is mounted adjacent the face for rotation between a closed position and an open position. The head is provided with an abutment which is in spaced relation from the front face. A U-shaped lock is disposed within the chambered head and is movable between a first position, where the lock holds the knuckle in the closed position, and a lockset position, where the knuckle is free to rotate from a closed to an open position. A lever is movable within the chambered head and coacts with the lock to move the lock from the first position to the lockset position. The lever is provided at one end thereof, with (I) a trunion which projects from the end into engagement with the lock, the lock being eccentrically mounted for tiltable rotation on the trunion, and (II) a lug which projects from the end in opposed relation to the trunion and engages the abutment to limit axial movement of the trunion and prevent disengagement of the trunion from the lock. Another aspect of the invention is the provision on the lever of a wedging surface to engage the lock and facilitate tiltable rotation of the lock to the lockset position.

DESCRIPTION OF THE DRAWING

The following description of the invention will be better understood by having reference to the annexed drawing, wherein.

DETAILED DESCRIPTION OF THE DRAWING

Figure 1:
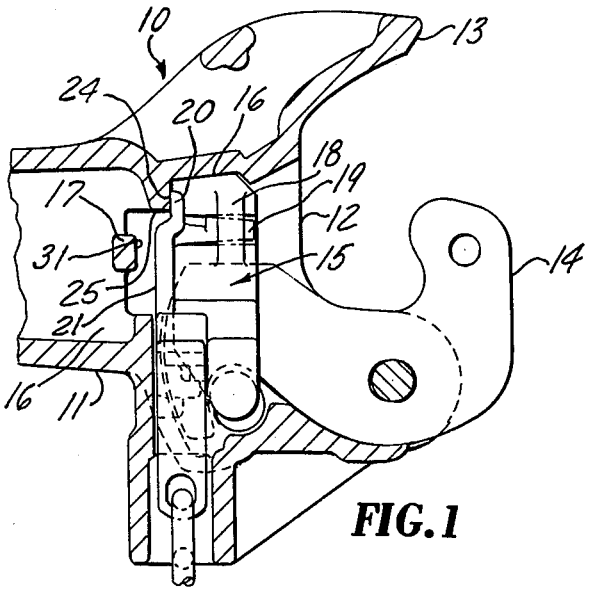
FIG. 1 (PRIOR ART)
FIG. 1 is a section of a prior art car coupler, as viewed from a horizontal plane, when the coupler is horizontally disposed.

With reference to FIGS. 1–8, there is shown a railroad car coupler 10 which comprises the essential components of a chambered head 11 having a front face 12, a guard arm 13 extending forwardly of the front face 12 in spaced relation from a knuckle 14 which is mounted adjacent the front face 12 for rotation between a closed position and an open position, and a locking mechanism 15 which is disposed within a chamber 16 of the head 11 and interlockingly engages the knuckle 14 to maintain it in a closed position.

Figure 2:
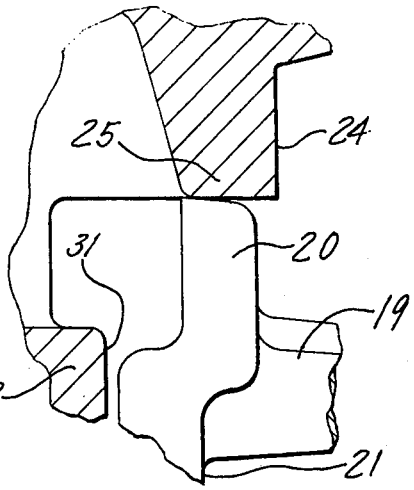
FIG. 2 is an enlarged view of a portion of the coupler of FIG. 1.
Figure 3:
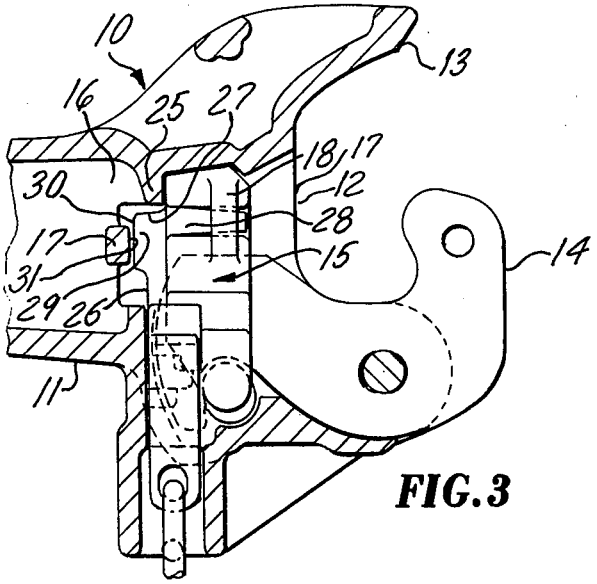
FIG. 3 is a section similar to that of FIG. 1, but of a car coupler embodying the invention.
Figure 4:
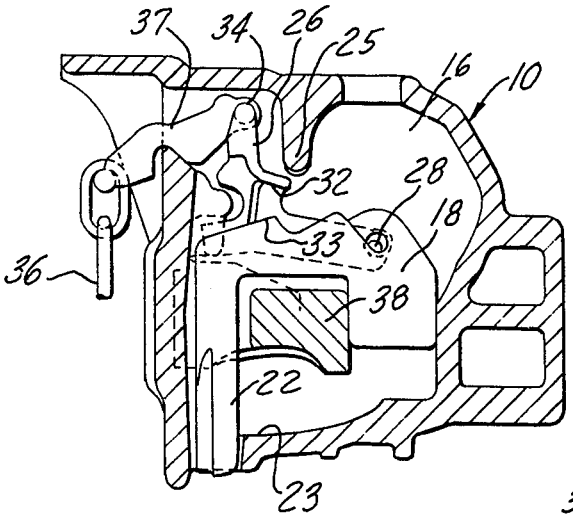
FIG. 4 is a section of the car coupler of FIG. 3, as viewed from a vertical plane, and illustrates the normal rest position of the lock when holding the knuckle in a closed position.
Figure 5:
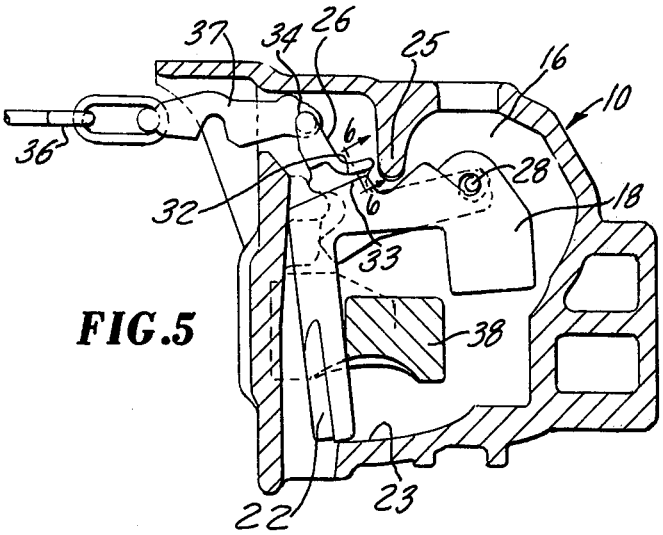
FIG. 5 is a section similar to FIG. 4, and illustrates the position of the lock in a lockset position where the knuckle is free to rotate to an open position.
Figure 8:
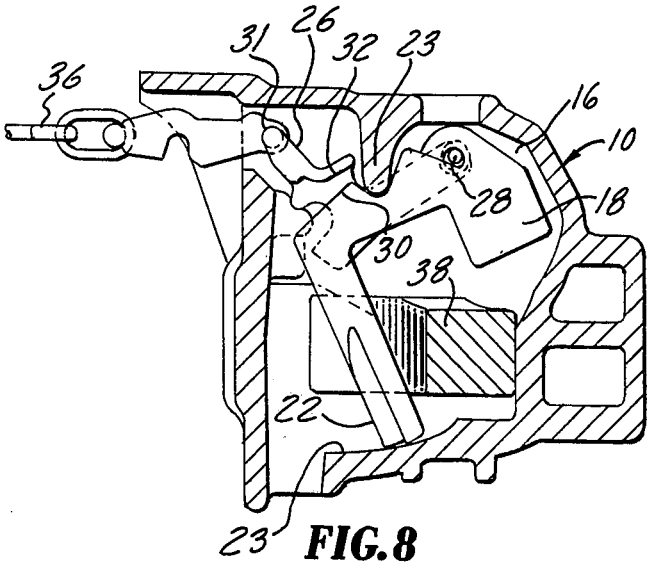
FIG. 8 is a section similar to that of FIG. 4, and illustrates the lock in a fully rotated position to engage and correspondingly rotate the knuckle to an open position.
Figure 6:
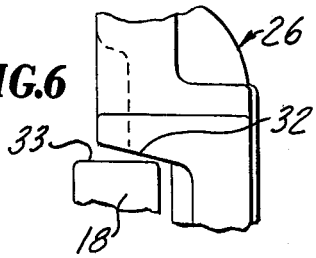
FIG. 6 is a section viewed from the line 6—6 of FIG. 5, and illustrates the wedging surface formed on the lock lifting lever.
Figure 7:
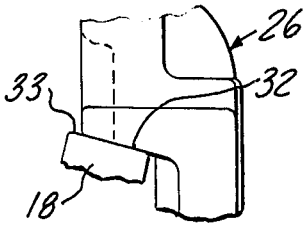
FIG. 7 is a section similar to that of FIG. 6, and illustrates the tilting of the lock by the wedging surface of the lever.
Figure 9:
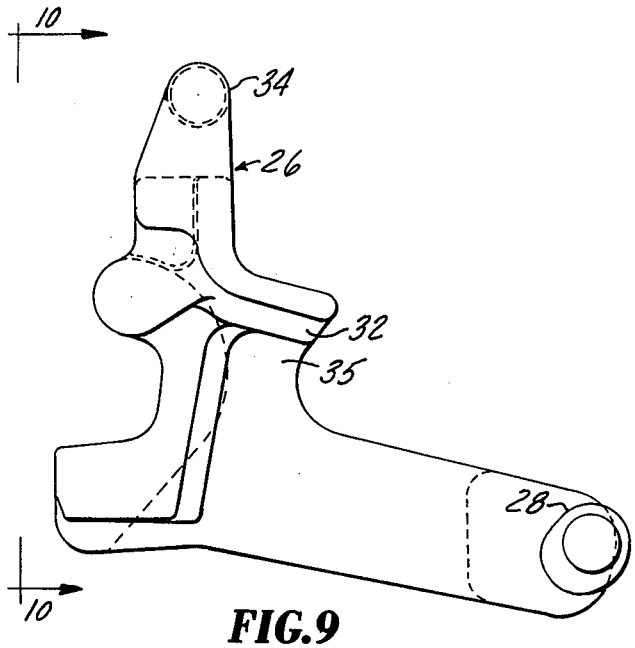
FIG. 9 is a side view of a lever which is used in lifting the lock from a normal rest position so that the lock is free of the knuckle to tiltably rotate to the lockset position.

The locking mechanism 15, shown in FIG. 1, is the same locking mechanism shown and described in U.S. Pat. No. 3,845,867. In fact, FIG. 1 is identical to FIG. 7 of the U.S. Pat. No. 3,845,867 patent, except for the showing of the abutment 17 which is normally formed within the chamber 16 of the head 11, but was not shown in FIG. 7 because it does not constitute an essential element of the invention disclosed and claimed in the U.S. Pat. No. 3,845,867 patent. The locking mechanism 15 of this patent comprises a U-shaped lock 18 which is eccentrically mounted for normal tiltable rotation on a conventionally tapered trunion 19 that projects from the free distal end 20 of a lever 21 that is utilized to lift the lock 18 from a first or rest position, as best seen in FIG. 6 of the U.S. Pat. No. 3,845,867 patent where the lock 18 maintains the knuckle 14 in a closed position, so that the lock 18 is free to move to a normal lockset position where a downwardly extending leg 22 of the lock 18 rests on an adjacent ledge 23 of the head 11 (FIG. 5) and the knuckle 14 is free to rotate to an open position. The free distal end 20 of the lever 21 rests against, and rides along the flat surface 24 of an adjacent rib 25 which is formed in the chamber 16 of the head 11. Because of the various clearances between the component parts of the locking mechanism and head, the free distal end 20 of the lever 21 occasionally becomes hung up against the projecting rib 25, as best seen in FIG. 2. The invention solves this particular problem, by removing the interfering portion of the free distal end 20 of the lever 21, as best understood by a comparison of FIGS. 1 and 3.

With reference to FIGS. 3–11, there is shown a lock lifting lever 26 which is made in accordance with the invention. The lever 26 has a free distal end 27 from which a tapered trunion 28 projects forwardly towards the knuckle 14 to engage the U-shaped lock 18, the lock 18 being eccentrically mounted on the trunion 28 so that it conventionally tilts as it rotates about the trunion 28, the tilting being in a plane normal to the plane of rotation of the lock 18. The free distal end 27 of the lever 26 is provided with a lug 29, which projects rearwardly away from the knuckle 14 in opposite relation to the trunion 28. The lug 29 extends towards the adjacently disposed abutment 17 which is formed in the chamber 16 of the head 11. The lug 29 comprises a flat side or surface 30 which parallels the adjacent flat face 31 of the abutment 17, and is in a plane that is perpendicular to the longitudinal axis of the trunion 28. Axial movement of the trunion 28 in a direction away from the lock 18 is abruptly halted as the lug 29 contacts the abutment 17. Thus the trunion 28 is prevented from becoming disengaged from the lock 18.

Figure 10:
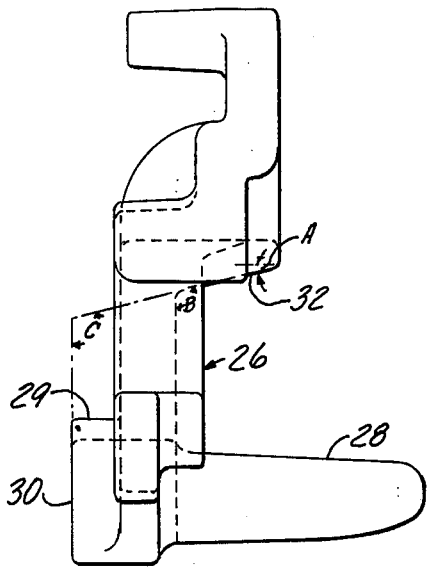
FIG. 10 is the lock lifting lever, as viewed from the line 10—10 of FIG. 9.
Figure 11:
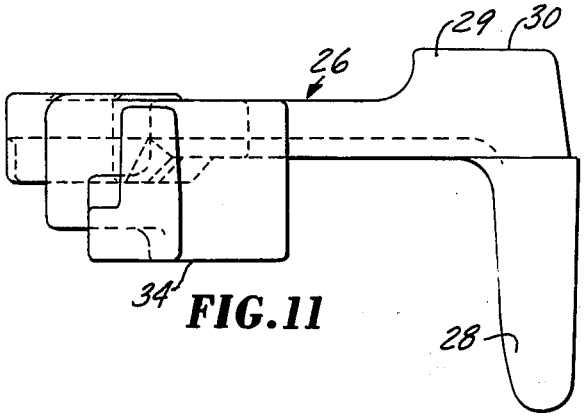
FIG. 11 is a plan view of the lock lifting lever.

As best seen in FIGS. 4–7 and 9–11, the lever 26 is provided with a wedging surface 32 which is arranged to engage an adjacent wedging surface 33 of lock 18, during the lifting of the lock 18 from its normal rest position in interlocked relation with the knuckle 14 when in a closed position. The lock 18 is forced to tilt and rotate to a lockset position (FIG. 5) by the coaction of the two wedging surfaces 32,33 as they engage. The wedging surface 32 of the lever 26, as best seen in FIG. 10, diverges from the closest spaced opposing end 34 of the lever 26. The wedging surface 32 slopes at an angle A of 15° relative to a horizontal plane so that the included angle B between the wedging surface 32 and adjacent vertically disposed side 35 of the lever 26 is 105°.

Thus, a positive, simultaneous tilting and rotational force is imparted to the lock 18 to tiltingly rotate it about the trunion 28, rather than relying on the weight of the lock 18 and its eccentric mounting as a means for causing tiltable rotation of the lock 18 to the lockset position.

A link chain 36 is coupled by a link element 37 to the lever 26 and is conventionally pulled, by hand, to actuate operation of the locking mechanism 15 to move the lock 18 (I) to a lockset position (FIG. 5), so that the knuckle 14 can be freely rotated to an open position, or (II) to a fully rotated position (FIG. 8) where the leg 22 of the lock 18 engages the tail 38 of the knuckle 14 and rotates the knuckle 14 to an open position.

Thus, there has been described a car coupler having a locking mechanism with an improved lock lifting lever which does not become hung up within the chamber of the head. The lever is provided with a special lug adjacent the end of the lever from which the interfering portion causing the hang-up has been removed, as previously explained and illustrated. The lug is unique in that it stabilizes movement of the lever within the chambered head and limits axial movement of the trunion to prevent the trunion from becoming disengaged from the lock. Moreover, the lever is provided with a special wedging surface for engaging an adjacent surface on the lock to impart to the lock, a positive tilting and rotational force to move, i.e., tilting rotate, the lock to a lockset position where the knuckle is free to be rotated to an open position. The plane of the wedging surface, as seen in FIG. 10, is angularly disposed to the plane of the flat surface of the lug such that the included angle C between the planes is about 105°.

What is claimed is:

1. A car coupler, comprising in combination:

(a) a head having a front face, a chamber adjacent the front face, and an abutment and rib disposed in the chamber in spaced relation from the front face, the abutment being farther spaced from the front face than the rib;

(b) a knuckle mounted adjacent the front face of the head for rotation between a closed position and an open position;

(c) a U-shaped lock disposed within the chamber of the head adjacent the rib and spaced from the abutment and movable from a first position, where the lock holds the knuckle in a closed position, to a lockset position where the knuckle is free to rotate from a closed position to an open position; and (d) a lever movable within the chamber of the head free of the rib and coacting with the lock to move the lock from the first position to the lockset position, the lever having at one end thereof, (I) a trunion projecting forwardly from the end in the direction of the knuckle for engaging the lock which is eccentrically mounted on the trunion; and (II) a lug projecting rearwardly from the end in a direction away from the knuckle and in opposed relation to the trunion, the lug being free of the rib and terminating adjacent the abutment and positioned to engage the abutment and limit axial movement of the trunion relative to the lock to prevent disengagement of the trunion from the lock.

2. The car coupler of claim 1, wherein the lug includes a planar surface which engages the abutment, the planar surface of the lug being in a plane that is perpendicular to the longitudinal axis of the trunion.

3. The car coupler of claim 1, wherein the lever includes a wedging surface, intermediate opposing ends of the lever, for engaging an adjacent wedging surface on the lock, the coaction of the wedging surfaces as they are compressed together causing limited tilting and rotation of the lock to the lockset position.

4. The car coupler of claim 3, wherein the wedging surface of the lever diverges from the vertically uppermost end of the lever when the lever is in a rest position where the lock is interlocked with a knuckle in a closed position on a horizontally disposed coupler.

5. The car coupler of claim 4, wherein the wedging surface of the lever is designed to tilt the lock in a plane which is normal to the plane in which the lock rotates about the trunion.

6. The car coupler of claim 5, wherein the wedging surface of the lever is flat, and the included angle (B) between the wedging surface and adjacent side of the lever is about 105°.

7. A lever movable within a chambered head of a knuckle-type coupler for lifting a U-shaped lock which maintains the knuckle of the coupler in a closed position, said lever having a pair of opposing ends, a trunion projecting from one end of the pair of opposing ends and on which the U-shaped lock is eccentrically mounted, a lug projecting from said one of the pair of opposing ends in opposite relation to the trunion for contacting an adjacent abutment in the chambered head to limit axial movement of the trunion in a direction away from the lock, and a wedging surface disposed intermediate the opposing ends of said lever, the wedging surface designed to engage and tiltably rotate the lock by imparting a positive tilting motion to said lock as it rotates within the chambered coupler head to a lockset position where the knuckle is free to rotate from a closed to an open position.

8. The lever of claim 7, wherein the lug includes a flat surface for contacting and riding along the abutment, the surface being in a plane which is normal to the longitudinal axis of the trunion.

9. The lever of claim 8, wherein the wedging surface of the lever diverges from the plane of the flat surface of the lug in a direction away from the trunion.

10. The lever of claim 9, wherein the wedging surface is in a plane which is angularly disposed to the plane of the flat surface, the included angle between said planes being about 105°.

* * * * *